US009564105B2

(12) United States Patent
Smith et al.

(10) Patent No.: US 9,564,105 B2
(45) Date of Patent: Feb. 7, 2017

(54) PROGRAMMABLE LEVEL SHIFTER FOR LCD SYSTEMS

(71) Applicant: Texas Instruments Deutschland GMBH, Freising (DE)

(72) Inventors: Nigel Peter Smith, Munich (DE); Roland Volker Bucksch, Buch am Erlbach (DE)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 0 days.

(21) Appl. No.: 14/301,884

(22) Filed: Jun. 11, 2014

(65) Prior Publication Data

US 2015/0364114 A1 Dec. 17, 2015

(51) Int. Cl.
*G09G 3/36* (2006.01)
*G09G 5/18* (2006.01)

(52) U.S. Cl.
CPC ..... *G09G 5/18* (2013.01); *G09G 3/3677* (2013.01); *G09G 3/3696* (2013.01); *G09G 2310/0289* (2013.01); *G09G 2370/08* (2013.01)

(58) Field of Classification Search
CPC ..... G09G 3/30; G09G 3/36; G09G 5/00; G09G 5/10; G09G 5/02; G06F 3/038
See application file for complete search history.

(56) References Cited

U.S. PATENT DOCUMENTS

2005/0156855 A1* 7/2005 Jang ..... G09G 3/3677 345/100
2008/0170057 A1* 7/2008 Park ..... G09G 3/3688 345/211
2010/0045708 A1* 2/2010 Higashino ..... G09G 3/3685 345/690
2012/0169681 A1* 7/2012 Moriwaki ..... G02F 1/13452 345/204
2014/0104248 A1* 4/2014 Won ..... G09G 5/00 345/204

OTHER PUBLICATIONS

Texas Instruments, "4-Clock Level Shifter for TFT-LCD Panel using GOA or GIP," TPS65199A, SLVSBS2—Aug. 2013 (39 pages).
Texas Instruments, "4-Clock Level Shifter for TFT-LCD Panel using ASG/GIP," TPS65195, SLVSAU7—Jun. 2013 (25 pages).

* cited by examiner

*Primary Examiner* — Pegeman Karimi
(74) *Attorney, Agent, or Firm* — William B. Kempler; Chares A. Brill; Frank D. Cimino

(57) ABSTRACT

A programmable level shifter for providing upshifted control signals to an active matrix display based on logic-level control signals received from a timing controller. The programmable level shifter includes a programmable state machine, level-shifting output drivers, and a programming interface. The programmable state machine is configured to receive at least one control signal from a timing controller. The state machine generates, based on said at least one control signal, a plurality of outputs for driving gate drivers of the active matrix display. The level-shifting output drivers convert the plurality of outputs generated by the programmable state machine to a higher-magnitude voltage level. The programming interface facilitates the programming of aspects of the programmable state machine.

16 Claims, 7 Drawing Sheets

| ADDRESS | BIT 3 | BIT 2 | BIT 1 | BIT 0 |
|---|---|---|---|---|
| 0 | 0 | 1 | 1 | 1 |
| 1 | 0 | 1 | 1 | 0 |
| 2 | 0 | 1 | 0 | 1 |
| 3 | 0 | 1 | 0 | 0 |
| 4 | 0 | 1 | 1 | 1 |
| 5 | 0 | 1 | 1 | 0 |
| 6 | 0 | 1 | 0 | 1 |

PROGRAMMABLE LEVEL SHIFTER FOR LCD SYSTEMS

BACKGROUND

Many liquid crystal displays (LCDs) and organic light emitting diode displays (OLEDs) use an active-matrix scheme to access the display's array of pixels. Early displays used row- and column-driver integrated circuits to access the rows and columns of the active matrix. More recently, the row driver function has been implemented on the display glass itself, eliminating the need for a printed circuit board (PCB) along one side of the display. Displays of this type require a level shifter to translate the logic-level signals generated by the timing controller (typically a few volts) to the higher voltages required by the display panel (typically −5 V to −10 V for the low levels and 20 V to 30 V for the high levels). FIG. 1 is a block diagram of such an LCD control system 100. The active matrix display 110 of FIG. 1 can be an LCD display or an OLED display. The column driver IC 130 drives the columns of the active matrix display 110. The row driving function is implemented by row driving functionality 120 on the display glass itself. In some implementations, the row drivers are referred to as gate drivers. The terms "row driver" and "gate driver" will be used interchangeably herein to refer to the same functionality and neither term should be construed to be limited to a particular implementation. The timing controller 140 generates timing control signals for the column drivers 130 and row driving functionality 120. The level shifter 150 translates the logic-level signals generated by the timing controller 140 to the higher voltages needed by the row driving functionality of the display 110. LCD systems that use this type of scheme are variously referred to as gate-in-panel (GIP) systems, amorphous silicon gate driver (ASG) systems, and gate driver-on-array (GOA) systems. All of these names refer to displays using essentially the same technology.

In current LCD systems, the timing controller 140 provides multiple input signals to the level shifter 150, which translates them into a number of clock signals (typically four or eight) and control signals (typically two or four) for the gate driving circuitry 120 embedded in the display glass 110. In the simplest implementation of this scheme, each channel in the level shifter 150 comprises one input and one output, and the timing controller 140 must generate a control signal for each channel. This approach is simple, but requires a high pin-count in both the timing controller 140 and the level shifter 150, and a large number of PCB traces between the two. Furthermore, any changes required to the output signals of the level shifter require the timing controller 140 to be changed, which is not easy to do.

In current state-of-the-art displays, the timing controller 140 encodes the information for the display in a reduced number of signals, and the level shifter 150 contains a state machine that decodes the information and uses it to control its outputs. This approach requires a lower pin-count in the timing controller 140 and level shifter 150 and fewer PCB connections between the two than the previous solution, but it still suffers from a number of limitations. One such limitation is that the output signal generation is defined by a fixed state machine and cannot be changed without design modifications to the level shifter 150 or the timing controller 140. Also, the number of PCB traces between the timing controller 140 and the level shifter 150 is still higher than display designers would like. In many display applications, PCB real estate is at a premium and, for cost or PCB thickness reasons, the number of PCB layers is limited. In addition, the rigidity of the fixed state machine system limits product design cycle-time, especially when changes to the LCD panel are made that may require different drive schemes. Furthermore, high-volume end-equipment often uses LCD display panels from multiple sources, and a number of level shifter variants may be required to accommodate them all. This typically results in higher component and manufacturing cost.

SUMMARY

One embodiment of the present invention is directed to a programmable level shifter for providing upshifted control signals to an active matrix display based on logic-level control signals received from a timing controller. The programmable level shifter includes a programmable state machine, level-shifting output drivers, and a programming interface. The programmable state machine is configured to receive at least one control signal from a timing controller. The state machine generates, based on said at least one control signal, a plurality of outputs for driving gate drivers of the active matrix display. The level-shifting output drivers convert the plurality of outputs generated by the programmable state machine to a higher-magnitude voltage level. The programming interface facilitates the programming of aspects of the programmable state machine.

Another embodiment of the invention is directed to an active matrix display system that includes an active matrix display and a programmable level shifter. The active matrix display includes a pixel array and integrated gate drivers that drive at least a portion of the pixel array. The programmable level shifter receives at least one control signal from a timing controller and generates, based on the at least one control signal, a plurality of outputs for driving the gate drivers of the active matrix display. The outputs for driving the gate drivers of the active matrix display are level-shifted such that they have a higher voltage than the at least one control signal received from the timing controller. The level shifter has a programming interface that allows aspects of the level shifter to be programmed.

A further embodiment of the invention is directed to a method of operating a level shifter that is operable to provide upshifted control signals to an active matrix display based on logic-level control signals received from a timing controller. Pursuant to said method, data is received from an external source via a programming interface. The received data is used to update the contents of a memory element of the level shifter. The contents of said memory element affect the substance of an output sequence that can be generated by the level shifter.

DETAILED DESCRIPTION

Figure 2:
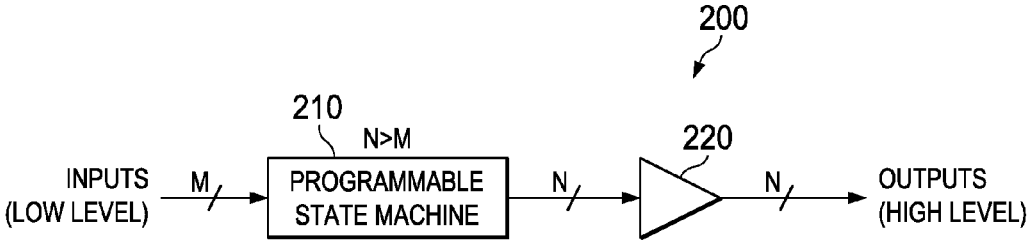
FIG. 2 is a block diagram of circuitry for a programmable level shifter.

FIG. 2 is a block diagram of circuitry, indicated generally at 200, for a programmable level shifter according to an illustrative embodiment of the invention. The programmable level shifter 200 includes a programmable state machine 210 and output drivers 220. The programmable state machine 210 enables the same integrated circuit to generate different output sequences depending on how it is programmed. The output drivers 220 convert the logic-level signals generated by the programmable state machine 210 to the higher magnitude voltage levels required by the gate drivers of the LCD display panel. The output sequence generated by the programmable state machine 210 can be programmed by a user without physically changing the IC. More than one sequence can be programmed in memory, and sequences can be switched dynamically to support different operating modes of the LCD panel. Since the output pattern of the level shifter 200 is not fixed, a single IC can support a variety of applications. This offers economies of scale, slower product obsolescence, reduced qualification effort, and a smaller bill of materials. In high-end applications, such as ultra-high definition (UHD) displays, the large number of level-shifter outputs can be achieved using two or more of the same device, but programming them differently (instead of developing dedicated level shifter solutions for each application).

Additionally, with the programmable state machine 210, certain control schemes can drastically reduce the number of control signals needed from the timing controller 140. A very small number of timing controller signals can be used to generate any sequence of clock signals and control signals for the gate-driving circuitry 120 in the display 110. This significantly reduces the number of electrical connections required between the timing controller 140 and the level shifter 150. In the extreme case only one such connection is required. This simplifies PCB layout and reduces the level shifter pin count (thereby also making it more suitable for integration with other functions).

Figure 3:
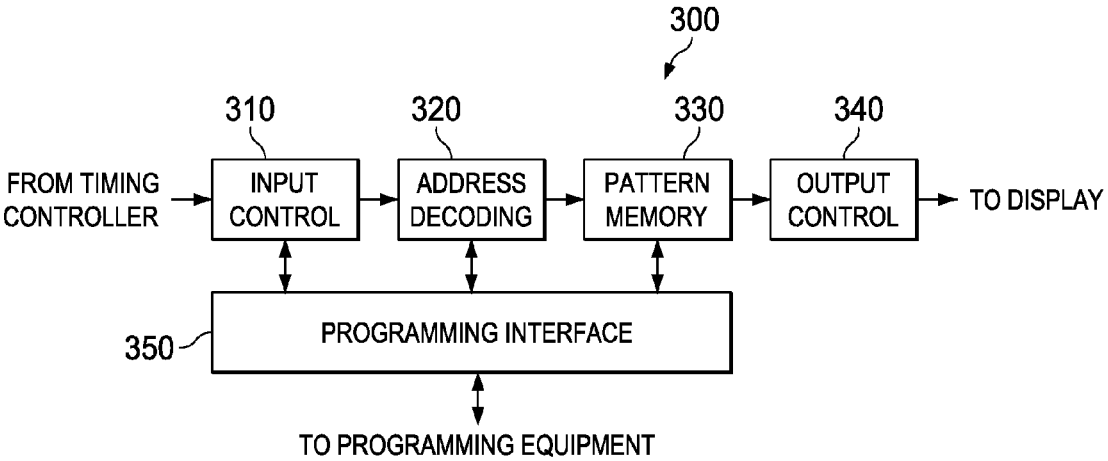
FIG. 3 is a block diagram of circuitry for a programmable level shifter.

FIG. 3 is a block diagram of circuitry, indicated generally at 300, for one implementation of a programmable level shifter. Input control block 310 recovers the control signals required by the internal logic from a small number of input signals generated by the timing controller 140. Pattern memory 330 contains the pattern to be generated. Address decoding logic 320 controls which word in pattern memory 330 is output at any given time. The output control stage 340 converts the logic-level memory word to the required output levels. The programming interface 350 allows a user to change the contents of the pattern memory 330 and associated registers. In an illustrative embodiment, the input control block 310, address decoding block 320, and pattern memory 330 constitute the programmable state machine 210 of FIG. 2.

Figures 4, 5:
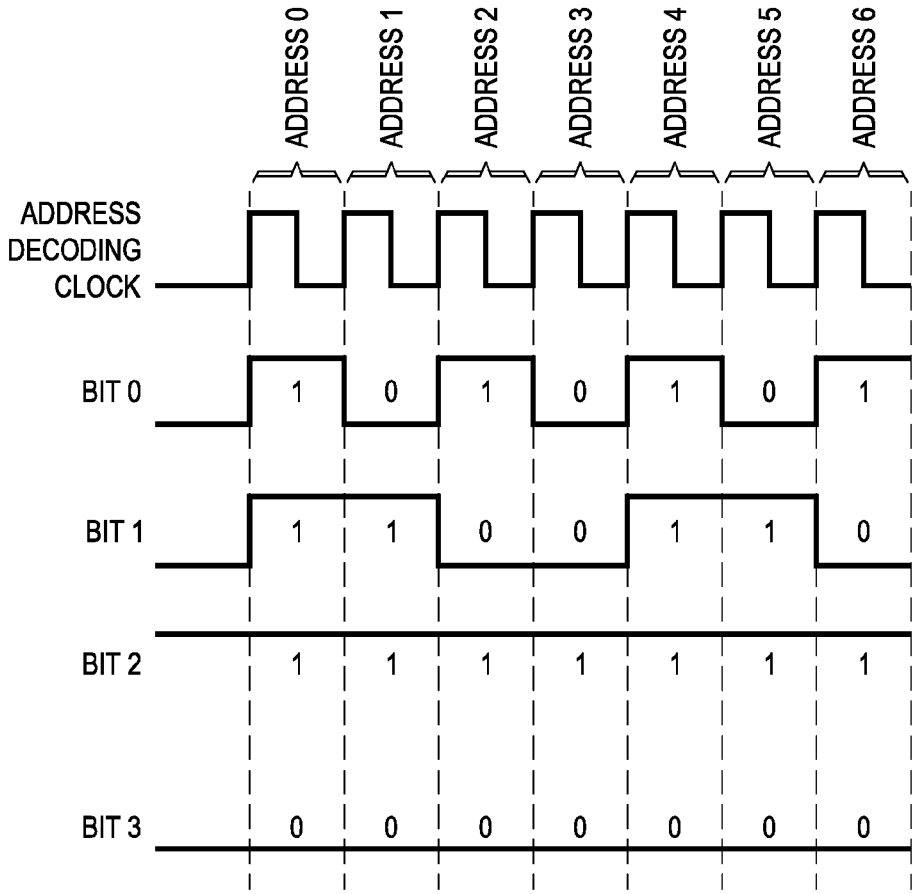
FIG. 4 is a chart showing the content of a seven-word portion of a level shifter pattern memory.
FIG. 5 is a timing diagram showing how the memory content of FIG. 4 corresponds to a particular output pattern.

The pattern memory 330 comprises a number of words, each word describing the state of the outputs at a specific point in the output sequence, i.e. they represent "time slices" of the output pattern. To illustrate the use of pattern memory 330 in generating output sequences, FIGS. 4 and 5 represent an example of a simple scheme for generating output sequences using pattern memory. FIG. 4 is a chart showing the content of a seven-word portion of the pattern memory 330, and FIG. 5 is a timing diagram showing how that memory content corresponds to a particular output pattern. In the illustrative example of FIGS. 4 and 5, one bit is used for each output, so output states can only be high or low. Since each bit corresponds to one output, four outputs can be generated with the 4-bit words. Other implementations might use more than one bit per output, e.g. to allow high, low, high impedance, charge sharing, and pre-charge states to be implemented. Referring to FIG. 4, the 4-bit word at memory address 0 is 0111. Thus, referring to FIG. 5, in the first output time-slot, i.e., the time-slot corresponding to memory address 0, the outputs corresponding to bits 0, 1, and 2 are high, and the output corresponding to bit 3 is low. Similarly, the 4-bit word at memory address 1 is 0110. Thus, in the second output time slot, which corresponds to memory address 1, the outputs corresponding to bits 1 and 2 are high, and the outputs corresponding to bits 0 and 3 are low. The outputs corresponding to bits 0-3 are determined similarly for the output time slots corresponding to memory addresses 2-6.

The address decoding block 320 uses a counter to convert the clock signals recovered by the input control block 310 to the appropriate pattern memory address. Since a single missed clock edge would disrupt display operation, in one embodiment system robustness is enhanced by adding a second control signal that periodically resets the address decoding so that each new frame is guaranteed to start at the correct memory location (e.g., the counter is reset). Since timing controllers typically generate a start pulse at the beginning of every frame anyway, this scheme can be easily adopted. In an alternative embodiment, this reset function is implemented by a watchdog timer that monitors the control signal received from the timing controller 140 and resets the address decoding if a pause in the control signal received from the timing controller that is longer than a specified time is detected. An advantage of this alternative embodiment is that it makes possible the minimum number of signals (one) between the timing controller 140 and the level shifter 300. However, this watchdog timer embodiment requires the timing controller 140 to generate a pause prior to the beginning of a frame, which may be difficult for some existing timing controllers to do.

Figure 6:
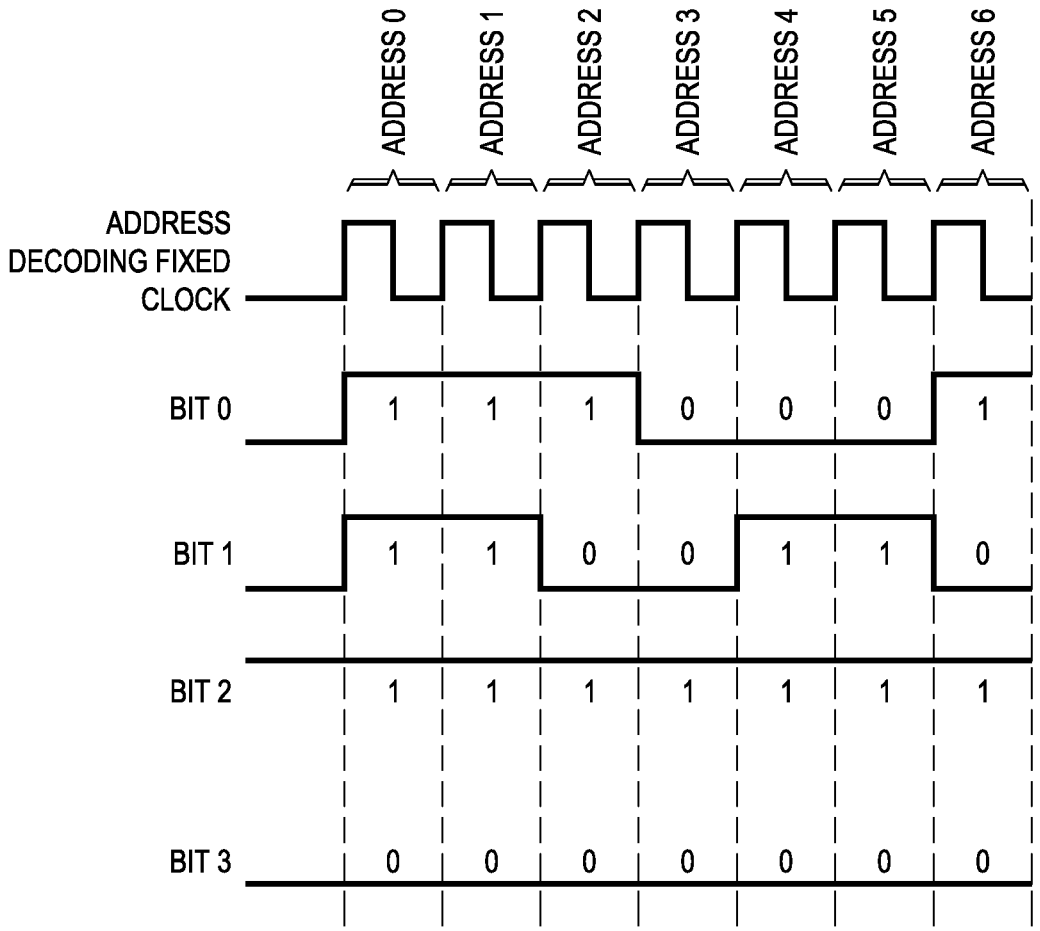
FIG. 6 is a timing diagram showing how a fixed clock can be used to generate a level sifter output sequence.

One embodiment of the address decoding block 320 uses a fixed clock signal, wherein the clock's high- and low-pulse durations are always the same, to control the address decoding. This scheme is easiest for the timing controller 140 to generate, but it uses the pattern memory 330 inefficiently because long output pulses can only be generated by storing the pulse in multiple successive addresses. The time-resolution of the output pattern when using a fixed-clock control scheme is limited to the frequency of the clock signal. FIG. 6 is a timing diagram showing how a fixed clock can be used to generate an output sequence by accessing in turn each word in the pattern memory 330.

Figure 7:
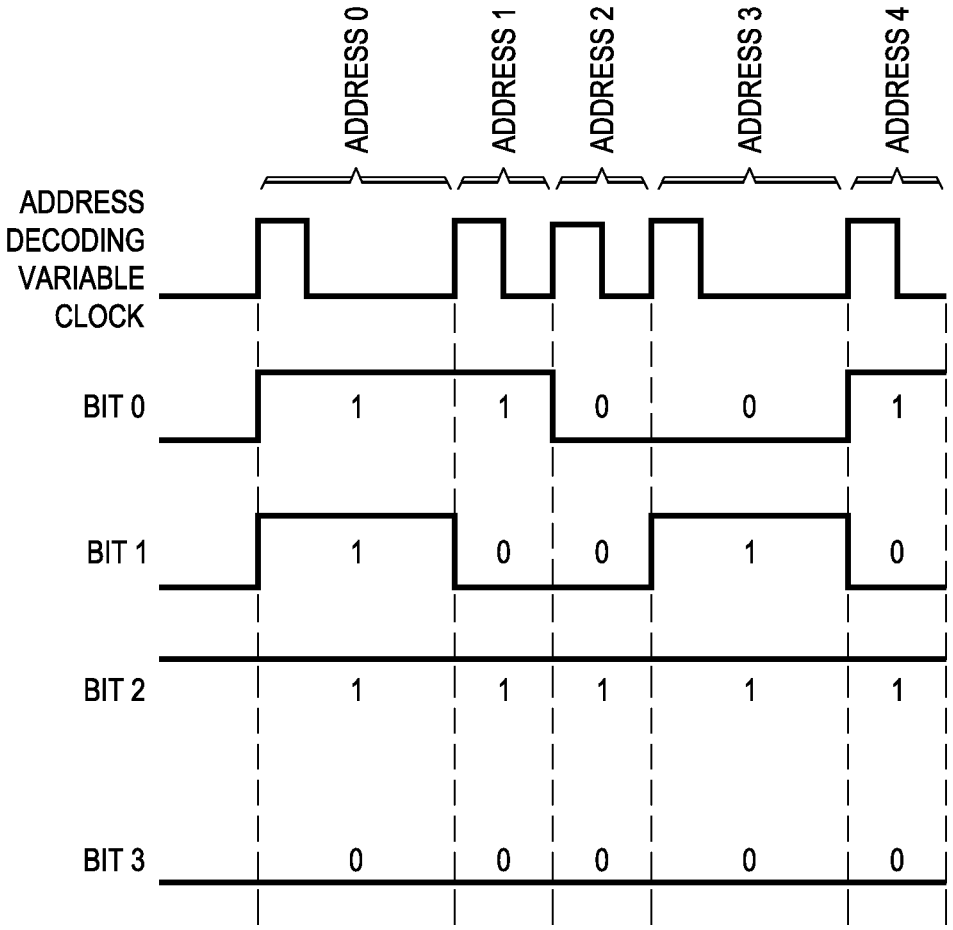
FIG. 7 is a timing diagram showing how a variable-clock scheme can be used to generate a level sifter output sequence.

Another embodiment of the address decoding block 320 uses a variable address decoding clock signal. A variable clock, in which the high- and low-pulse durations are not always the same, enables the most efficient use of the pattern memory 330 because duplicate words in successive pattern memory addresses are never needed; longer periods of unchanging output states are generated by stretching the time before the next clock pulse is generated. FIG. 7 is a timing diagram showing how a variable-clock scheme can be used to generate the same output sequence as FIG. 6, but using only five words of pattern memory instead of seven. The time resolution of a variable clock implementation is determined primarily by the capability of the timing controller 140 to generate the required signal. Thus the ability of the timing controller to generate an irregular waveform is most likely the main factor limiting the performance of a variable-clock scheme.

Figure 8:
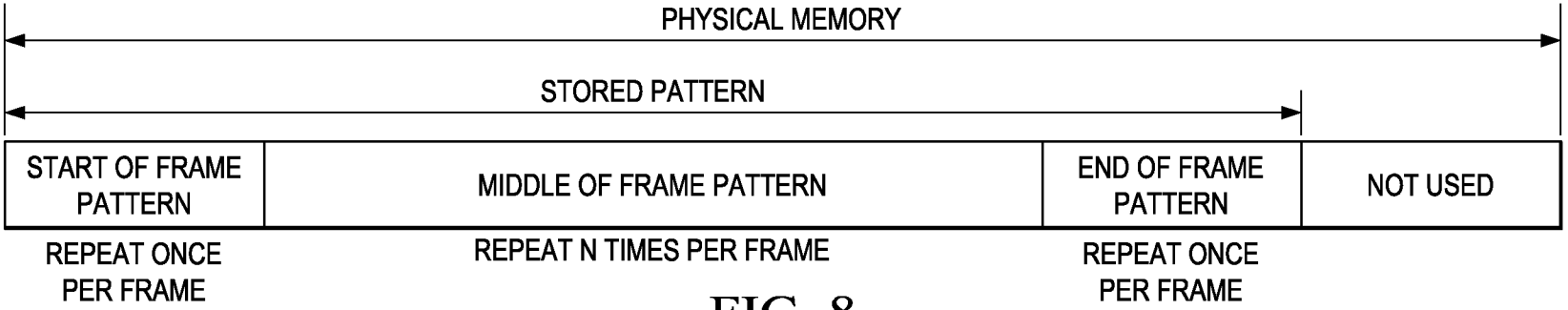
FIG. 8 is a data structure diagram showing the structure of an output pattern data frame.

In typical applications, some memory blocks (e.g., the start and the end of the frame) will be implemented one time per frame, and others (e.g. the middle of the frame) will comprise a small section repeated a number of times. FIG. 8 is a data structure diagram showing how the contents of a pattern memory might look in a typical application. In an illustrative embodiment of the invention, the address decoding block 320 includes a number of control registers that are programmed at the same time as the pattern memory 330. Some of these control registers define certain parameters associated with a particular pattern, for example, the lengths of the start-of-frame section, middle-of-frame section, and end-of-frame section, and the number of times the middle-of-frame section is to be repeated. In a further embodiment, programmable registers in the address decoding block 320 dictate how the various control inputs should be combined to generate internal clock signals.

Figure 9:
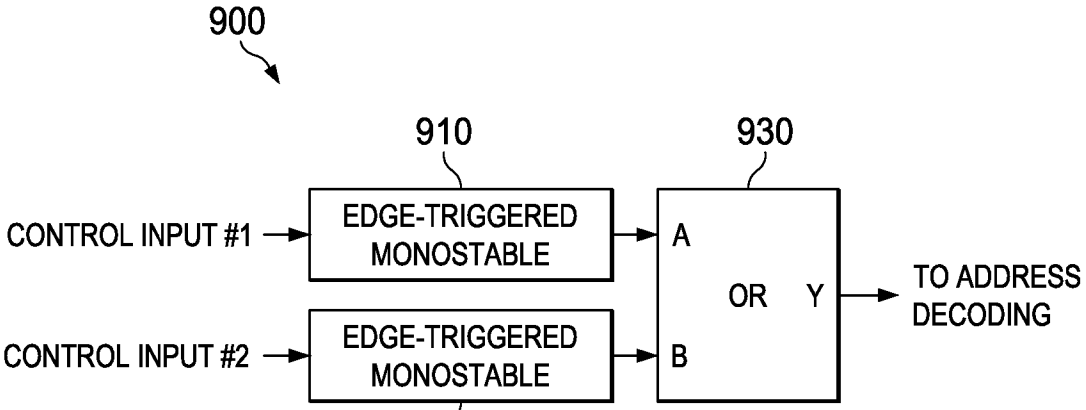
FIG. 9 is a block diagram of circuitry for a control signal reconstruction block that reconstructs a variable-clock signal from two fixed-clock signals.
Figure 10:
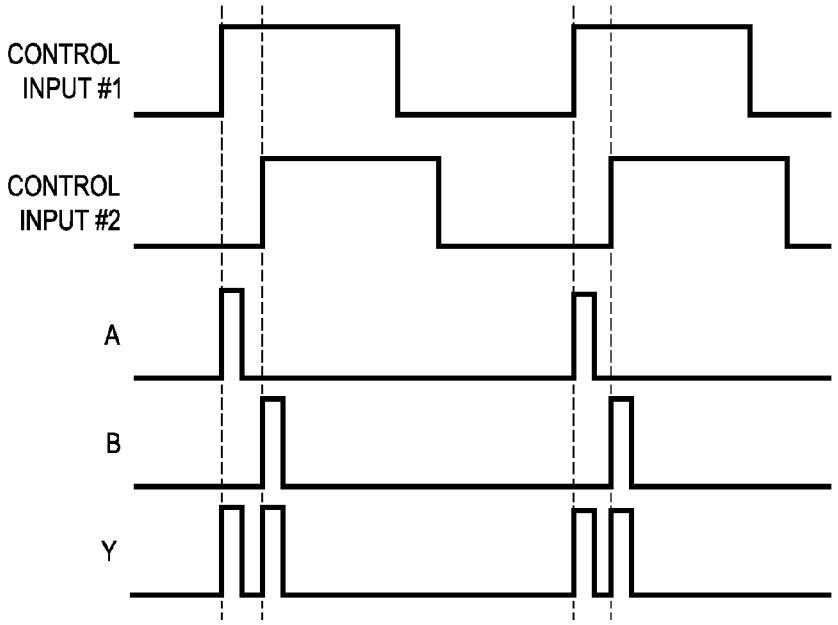
FIG. 10 is a timing diagram showing the waveforms generated by the control signal reconstruction block of FIG. 9.

Input control block 310 recovers the control signals required by the internal logic of the level shifter 300 from a small number of input signals generated by the timing controller 140. In one embodiment, in applications where it is not desirable or not possible to generate a variable clock (e.g., because of timing controller limitations), the input control block 310 reconstructs a clock signal for the addressing logic from multiple control signals generated by the timing controller 140. This approach has the additional advantage that the level shifter 300 can be made compatible with existing timing controllers. FIG. 9 is a block diagram representing an illustrative control signal reconstruction block, indicated generally at 900, that reconstructs a variable-clock signal from two fixed-clock signals generated by a timing controller 140. FIG. 10 is a timing diagram showing the waveforms generated by the control signal reconstruction block of FIG. 9. The control signal reconstruction block 900 of FIG. 9 is illustrative only and the input control block 310 can include numerous other control signal reconstruction schemes. The control signal reconstruction block 900 receives two control inputs from the timing controller 140. These control inputs are shown in FIGS. 9 and 10 as control input #1 and control input #2. As can be seen in FIG. 10, control inputs #1 and #2 are fixed clock signals that are offset from one another by a certain amount. Control input #1 is provided to edge-triggered monostable signal generator 910 and control input #2 is provided to edge-triggered monostable signal generator 920. Edge-triggered monostable signal generator 910 generates signal A as shown in FIG. 10 and edge-triggered monostable signal generator 920 generates signal B as shown in FIG. 10. Signals A and B are provided to OR block 930. Performing a logical OR operation on signals A and B results in signal Y as shown in FIG. 10. The resulting signal Y is then provided to the address decoding block 320 as a variable clock signal.

In one embodiment of the invention, the input control block 310 includes registers that define various parameters used by the input control block in the processing of control signals received from the timing controller 140. These input control registers can be programmed via the programming interface 350.

The output control block 340 converts the logic-level signals generated by the pattern memory 330 to the higher-magnitude voltage levels of the level shifter outputs. In one embodiment, the pattern memory 330 generates one signal for each output channel, which can be either high or low. Other, more complex, embodiments use more than one bit per output channel, for example, if it is also required to generate a high impedance state or implement charge sharing. In one embodiment, the output control block 340 is also able to generate output signals that are not level-shifted, i.e., they are of the same voltage level as the control signal received from the timing controller 140.

The programming interface 350 is a means of changing the contents of the pattern memory 330 and the contents of registers that are associated with the pattern memory 330, the input control block 310, and the address decoding block 320. For example, registers in the address decoding block 320 can be programmed to select how many times the middle-of-frame section in pattern memory is repeated, as discussed above with respect to FIG. 8. To program the contents of the pattern memory 330 or a register, a user provides the information to be programmed to the programming interface 350, which in turn programs the pattern memory 330 or the appropriate register with the information. In one embodiment, the programming interface 350 uses the I2C bus standard, but other industry standards can be used also, as well as proprietary schemes. Programming of the level shifter 300 can take place at a variety of times in accordance with the present invention, including during IC manufacture, on the end customer production line, by the IC distributor, or by the end user.

Figure 1:
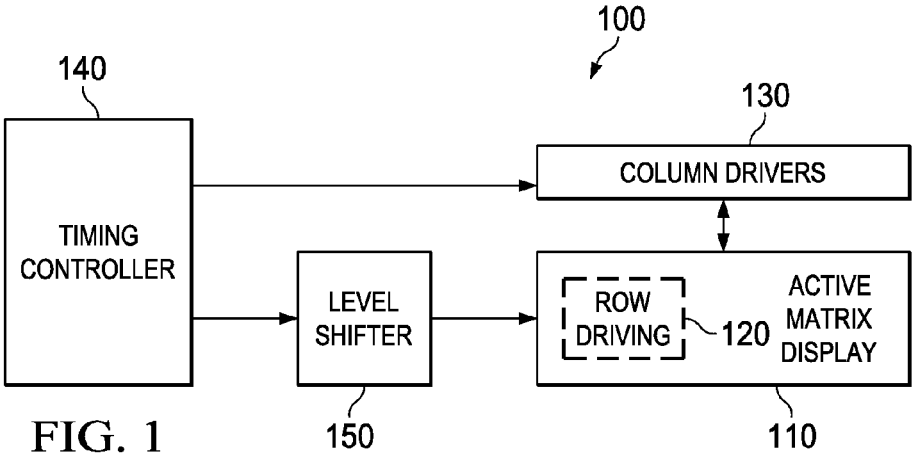
FIG. 1 is a block diagram of an LCD control system employing a level shifter.
Figure 11:
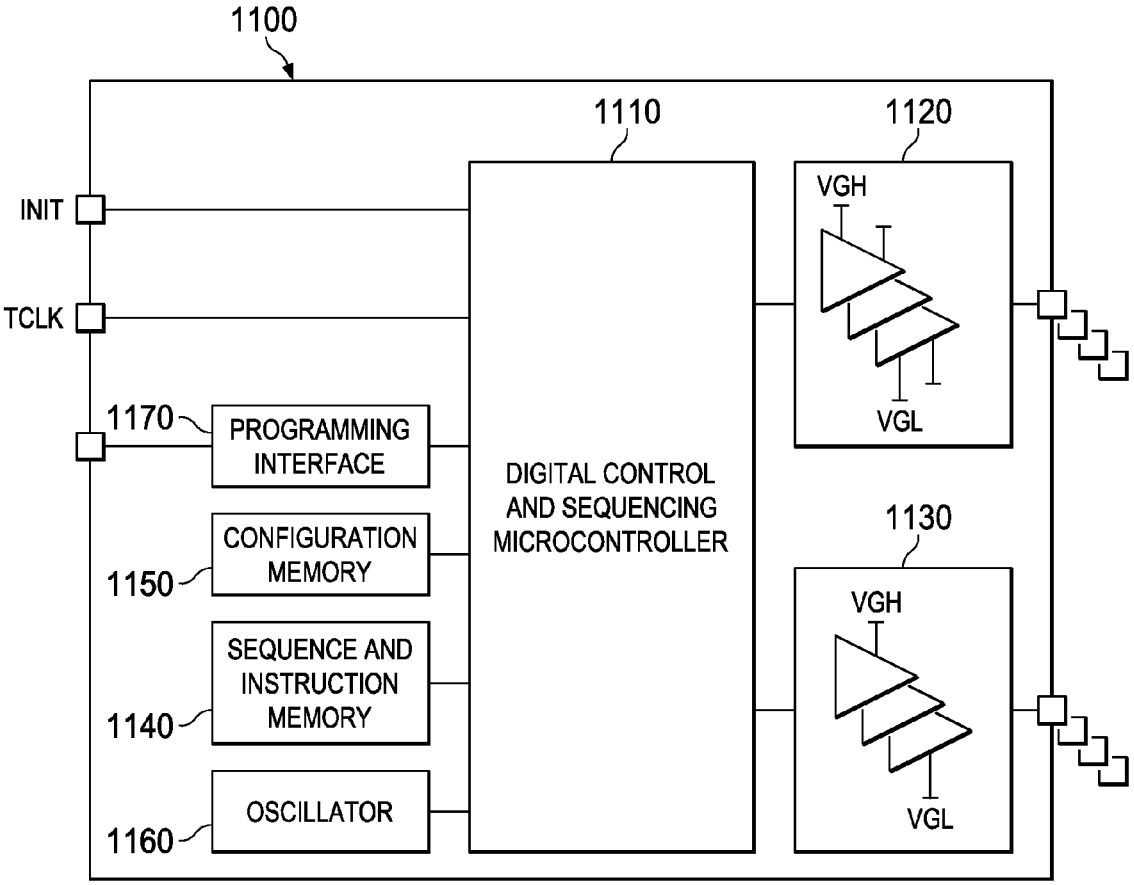
FIG. 11 is a block diagram of circuitry for a microcontroller-based programmable level shifter.

In an alternative embodiment of the present invention, the programmable level shifter is implemented with a microcontroller that executes micro-code instructions. In this embodiment, a set of instruction codes and arguments are stored in memory the same way as the pattern code itself. The level shifter is programmed by modifying the microcontroller's microcode. FIG. 11 is a block diagram representing a microcontroller-based programmable level shifter 1100 according to an illustrative embodiment of the present invention. The digital control and sequencing microcontroller 1110 receives timing control (TCLK) signals from a timing controller such as timing controller 140 in FIG. 1. The digital control and sequencing microcontroller 1110 decodes the control signals received from the timing controller 140 and, in response thereto, retrieves and executes instructions stored in sequence and instruction memory 1140. The execution of these instructions causes the generation of the gate driver control signals that are to be provided to the gate drivers 120 of the LCD panel 110. These logic-level gate driver signals are provided to the level shifter output drivers 1120 and 1130. The level shifter output drivers 1120 and 1130 convert the logic-level signals received from the digital control and sequencing microcontroller 1110 to higher-voltage signals and provides the upshifted signals to the gate drivers 120 of the active matrix display 110. The sequence and instruction memory 1140 stores a set of instruction codes and arguments that dictate the generation of the output sequences that the level shifter 1100 provides to the gate drivers 120 of the LCD panel 110. These instruction codes include execute instructions which cause the data in the argument to be decoded and applied to the level shifter outputs. The instruction codes further include, for example, loop instructions, conditional and unconditional jumps, simple arithmetic, and branching, as will be described in more detail below. Configuration memory 1150 stores information relating to the configuration of the digital control and sequencer 1110. In an illustrative embodiment, the digital control and sequencing microcontroller 1110, sequence and instruction memory 1140, and configuration memory 1150 constitute the programmable state machine 210 of FIG. 2.

Oscillator 1160 provides clock signals to the digital control and sequencing microcontroller 1110 during times when the timing controller 140 may be shut down and is not providing a clock signal to the level shifter 1100 but the level shifter must continue to generate and provide dynamic signals to the LCD panel 110. One example of this is during the blanking time between two frames. But during normal operation, the digital control and sequencing microcontroller 1110 runs directly off of the timing controller 140 clock as it minimizes timing errors (jitter) between the timing controller-provided control signal and high-voltage output signals of the programmable level shifter 1100.

Programming interface 1170 is a means of changing the contents of the sequence and instruction memory 1140 and configuration memory 1150. For example, the instructions and sequence data stored in the sequence and instruction memory 1140 can be programmed in order to define the substance of, and certain parameters associated with, a particular output pattern, as will be appreciated from the explanation of illustrative instruction codes below with reference to FIG. 12. To program the contents of the sequence and instruction memory 1140 or configuration memory 1150, a user provides the information to be programmed to the programming interface 1170, which in turn provides the information to the digital control and sequencing microcontroller 1110, which in turn programs the appropriate memory module with the information. In one embodiment, the programming interface 1170 uses the I2C bus standard, but other industry standards can be used also, as well as proprietary schemes. Programming of the level shifter 300 can take place at a variety of times in accordance with some embodiments of the present invention, including during IC manufacture, on the end customer production line, by the IC distributor, or by the end user.

Figure 12:
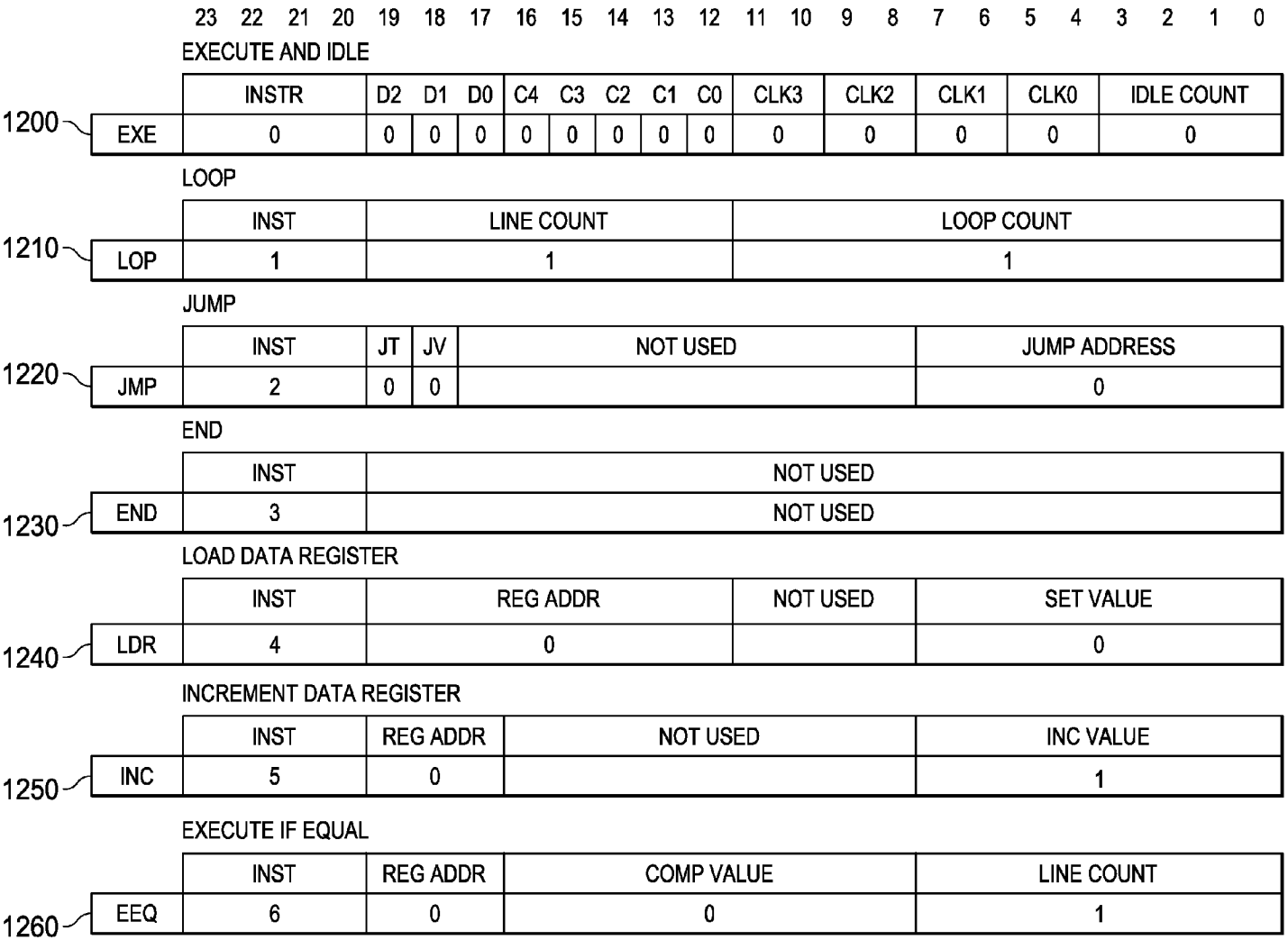
FIG. 12 is a data structure diagram showing the structure of illustrative instructions that can be executed by the digital control and sequencing microcontroller of FIG. 11.

As explained above, the digital control and sequencing microcontroller 1110 retrieves and executes instruction codes stored in sequence and instruction memory 1140. At each step through the code, the digital control and sequencing microcontroller 1110 decodes the instruction header and then decides how to process the information stored in the instruction's argument. FIG. 12 is a data structure diagram showing the structure of various instructions that are executed by the digital control and sequencing microcontroller 1110 in the generation of output sequences in accordance with an illustrative embodiment of the invention. The simplest instruction is an EXECUTE (EXE) instruction 1200 which instructs the microcontroller 1110 to decode the data held in the instruction argument and apply it to the level shifters 1120 and 1130 in a manner similar to the decoding of sequences described with respect to FIGS. 4 and 5. An "IDLE COUNT" parameter defines the number of clock cycles for which the data will remain steady on the level shifter outputs as the sequencer advances to the next address. The idle function allows the microcontroller 1110 to run from a fixed clock as described with respect to FIGS. 5 and 6 without the need for duplicating EXE instructions in memory. A LOOP (LOP) command 1210 repeats the following "LINE COUNT" number of instructions "LOOP COUNT" times. A JUMP (JMP) instruction 1220 sets the program counter to a defined "JUMP ADDRESS" value. If the "JT" bit is set to 1, the program counter is updated only if a hardware pin matches the value of "JV." This enables conditional jumps under hardware control. The END (END) instruction 1230 terminates the sequence. The sequence restarts when a reset (INIT) pulse is received from the timing controller 140, indicating the start of a new frame. The LOAD DATA REGISTER (LDR) instruction 1240 copies an 8-bit value ("SET VALUE") to a register with address "REG ADDR." This is useful for initializing a count register, manipulating a pattern start address, or changing a configuration register on the fly. The INCREMENT (INC) instruction 1250 increments the value stored in the register with address "REG ADDR" by "INC VALUE." The EXECUTE IF EQUAL (EEQ) instruction 1260 defines how many lines of code, starting with the next line in pattern memory, are executed if the register with address "REG ADDR" contains a value matching "COMP VALUE."

Although illustrative embodiments have been shown and described by way of example, a wide range of alternative embodiments is possible within the scope of the foregoing disclosure.

What is claimed is:

1. An active matrix display system comprising:

an active matrix display comprising a pixel array and comprising integrated gate drivers operable to drive at least a portion of the pixel array; and a programmable level shifter operable to receive at least one control signal from a timing controller and operable to generate, based on said at least one control signal, a plurality of outputs for driving the gate drivers of the active matrix display, wherein the outputs for driving the gate drivers of the active matrix display are level-shifted such that they have a higher-magnitude voltage than the at least one control signal received from the timing controller, and wherein the level shifter comprises a programming interface that allows aspects of the level shifter to be programmed, wherein the programmable level shifter further comprises:

a programmable state machine operable to receive at least one control signal from the timing controller and operable to generate, based on said at least one control signal, a plurality of outputs for driving the gate drivers of the active matrix display; and level-shifting output drivers operable to convert the plurality of outputs generated by the programmable state machine to a higher-magnitude voltage level.

2. The active matrix display system of claim 1 wherein the active matrix display comprises a liquid crystal display.

3. The active matrix display system of claim 1, further comprising a timing controller operable to provide the control signals to the level shifter.

4. The active matrix display system of claim 1 wherein the programmable level shifter is operable to generate, based on said control signals, an output sequence at each of the plurality of outputs for driving the gate drivers of the active matrix display.

5. The active matrix display system of claim 1 wherein a programming interface is operable to receive data from an external source and to provide said data to a memory element of the programmable level shifter in order to modify the contents of said memory element.

6. An active matrix display system comprising:

an active matrix display comprising a pixel array and comprising integrated gate drivers operable to drive at least a portion of the pixel array; and a programmable level shifter operable to receive at least one control signal from a timing controller and operable to generate, based on said at least one control signal, a plurality of outputs for driving the gate drivers of the active matrix display, wherein the outputs for driving the gate drivers of the active matrix display are level-shifted such that they have a higher-magnitude voltage than the at least one control signal received from the timing controller, and wherein the level shifter comprises a programming interface that allows aspects of the level shifter to be programmed, wherein the programmable state machine comprises:

a pattern memory that stores output sequences, each memory location storing data representing a state of the plurality of outputs at a specific point in an output sequence; and an address decoding block that decodes the at least one input signal received from the timing controller to determine an address of a memory location in pattern memory whose contents are to be output to the level-shifting output drivers as part of an output sequence.

7. The active matrix display system of claim 6 wherein a programming interface is operable to receive data from an external source and to provide said data to the pattern memory in order to effect the storage of a new output sequence.

8. A programmable level shifter for providing upshifted control signals to an active matrix display based on logic-level control signals received from a timing controller, the programmable level shifter comprising:

a programmable state machine operable to receive at least one control signal from a timing controller and operable to generate, based on said at least one control signal, a plurality of outputs for driving gate drivers of the active matrix display, wherein the programmable state machine comprises:

a pattern memory that stores output sequences, each memory location storing data representing a state of the plurality of outputs at a specific point in an output sequence; and an address decoding block that decodes the at least one input signal received from the timing controller to determine an address of a memory location in pattern memory whose contents are to be output to the level-shifting output drivers as part of an output sequence;

level-shifting output drivers operable to convert the plurality of outputs generated by the programmable state machine to a higher-magnitude voltage level; and a programming interface operable to facilitate the programming of aspects of the programmable state machine, wherein the programming interface is operable to receive data from an external source and to provide said data to a memory element of the programmable state machine in order to modify the contents of said memory element.

9. The programmable level shifter of claim 8 wherein the programming interface is operable to receive data from an external source and to provide said data to the pattern memory in order to effect the storage of a new output sequence.

10. The programmable level shifter of claim 8 wherein the address decoding block comprises at least one register that defines a parameter associated with a specific output pattern, and wherein the programming interface is operable to receive data from an external source and to provide said data to one of the registers in order to modify a parameter associated with a specific output pattern.

11. The programmable level shifter of claim 8 wherein the programmable state machine comprises:

a sequence and instruction memory that stores micro-code instructions that implement the generation of output sequences; and a microcontroller operable to retrieve micro-code instructions from the sequence and instruction memory and execute said micro-instructions in order to generate output sequences for provision to the level shifting output drivers via the plurality of outputs.

12. The programmable level shifter of claim 11 wherein the programming interface is operable to receive data from an external source and to provide said data to the sequence and pattern memory in order to create a new micro-code instruction associated with the generation of an output sequence.

13. The programmable level shifter of claim 12 wherein the micro-code instructions stored in the sequence and instruction memory for execution by the microcontroller comprise an execute instruction whose argument comprises data representing output signals to be provided to the level shifting output drivers via the plurality of outputs upon execution of said instruction.

14. The programmable level shifter of claim 8 wherein the programmable state machine further comprises an input control block operable to receive the control signals from the timing controller generate control signals required by the address decoding block based on the received control signals, wherein the input control block comprises at least one input control register that defines a parameter associated with the processing of control signals received from the timing controller, and wherein the programming interface is operable to receive data from an external source and to provide said data to one of the input control registers in order to modify a parameter associated with the processing of control signals received from the timing controller.

15. A method of operating a level shifter that is operable to provide upshifted control signals to an active matrix display based on logic-level control signals received from a timing controller, the method comprising:

receiving, via a programming interface, data from an external source;

updating the contents of a memory element of the level shifter with the received data, wherein the contents of said memory element affect an output sequence generated by the level shifter;

further comprising:

receiving, from a timing controller, at least one control signal;

generating, based on said at least one control signal, and further based on the updated contents of said memory element of the level shifter, a plurality of outputs for driving gate drivers of the active matrix display;

converting the plurality of outputs to a higher-magnitude voltage level; and providing the converted plurality of outputs to the gate drivers of the active matrix display.

16. The method of claim 15 wherein updating the contents of a memory element comprises updating the contents of a sequence and instruction memory that stores micro-code instructions that implement the generation of output sequences, and wherein generating a plurality of outputs comprises retrieving and executing micro-code instructions from the sequence and instruction memory in order to generate output sequences for driving the gate drivers of the active matrix display.

* * * * *